US009768519B2

(12) United States Patent
Ito et al.

(10) Patent No.: US 9,768,519 B2
(45) Date of Patent: Sep. 19, 2017

(54) WIRELESS COMMUNICATION DEVICE AND WIRELESS COMMUNICATION METHOD

(71) Applicant: Kabushiki Kaisha Toshiba, Minato-ku, Tokyo (JP)

(72) Inventors: Takayoshi Ito, Kanagawa (JP); Koji Akita, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 507 days.

(21) Appl. No.: 14/471,592

(22) Filed: Aug. 28, 2014

(65) Prior Publication Data

US 2015/0077289 A1 Mar. 19, 2015

(30) Foreign Application Priority Data

Sep. 19, 2013 (JP) ..... 2013-193720

(51) Int. Cl.
*H01Q 21/06* (2006.01)
*H01Q 21/24* (2006.01)

(52) U.S. Cl.
CPC ..... *H01Q 21/24* (2013.01)

(58) Field of Classification Search
CPC ..... H01Q 21/06; H01Q 21/24; H01Q 3/00; H04B 7/10
USPC ..... 342/365
See application file for complete search history.

(56) References Cited

U.S. PATENT DOCUMENTS 7,316,159 B2 1/2008 Fujioka et al.
2002/0167449 A1* 11/2002 Frazita ..... H01Q 1/42 343/756
2010/0171675 A1* 7/2010 Borja ..... H01Q 1/38 343/798
2012/0081259 A1* 4/2012 Regala ..... H01Q 21/26 343/797
2014/0303928 A1* 10/2014 Sgarz ..... B25F 5/00 702/151
2014/0347210 A1* 11/2014 Sgarz ..... G01V 3/12 342/146

FOREIGN PATENT DOCUMENTS

JP 2005-047460 A 2/2005
JP 2013-158070 A 8/2013

* cited by examiner

*Primary Examiner* — Harry Liu
(74) *Attorney, Agent, or Firm* — Knobbe, Martens, Olson & Bear, LLP

(57) ABSTRACT

According to one embodiment, a wireless communication device includes a first antenna. The wireless communication device includes a second antenna which performs at least one of transmission and reception of an electromagnetic wave to and from the first antenna while rotating at a predetermined position or revolving along a predetermined orbit. The first antenna is arranged such that an element of the first antenna is not to be parallel to a plane perpendicular to a polarization plane of the electromagnetic wave which is transmitted from one antenna toward the other antenna while the second antenna rotates or revolves.

16 Claims, 15 Drawing Sheets

WIRELESS COMMUNICATION DEVICE AND WIRELESS COMMUNICATION METHOD

CROSS-REFERENCE TO RELATED APPLICATIONS

This application is based upon and claims the benefit of priority from Japanese Patent Application No. 2013-193720, filed Sep. 19, 2013; the entire contents of which are incorporated herein by reference.

FIELD

Embodiments of the present invention relate to a wireless communication device and a wireless communication method.

BACKGROUND

A surveillance camera has an imaging unit on a base member which is fixed on a placing surface. When transmitting and receiving a signal between the base member and the imaging unit, the signal has been transmitted and received via a slip ring built in the surveillance camera.

However, an existing slip ring brings a circular electrical path which is concentrically arranged with respect to a rotating body into contact with a brush to transmit the signal between the electrical path and the brush, sometimes leading to a case of unstable signal transmission. Therefore, quality of the signal disadvantageously has deteriorated in some cases when the signal is transmitted at a high speed.

DETAILED DESCRIPTION

According to one embodiment, a wireless communication device includes a first antenna. The wireless communication device includes a second antenna which performs at least one of transmission and reception of an electromagnetic wave to and from the first antenna while rotating at a predetermined position or revolving along a predetermined orbit. The first antenna is arranged such that an element of the first antenna is not to be parallel to a plane perpendicular to a polarization plane of the electromagnetic wave which is transmitted from one antenna toward the other antenna while the second antenna rotates or revolves.

Hereinafter, a description is given in detail below of embodiments of the present invention with reference to the drawings.

First Embodiment

Figure 1:
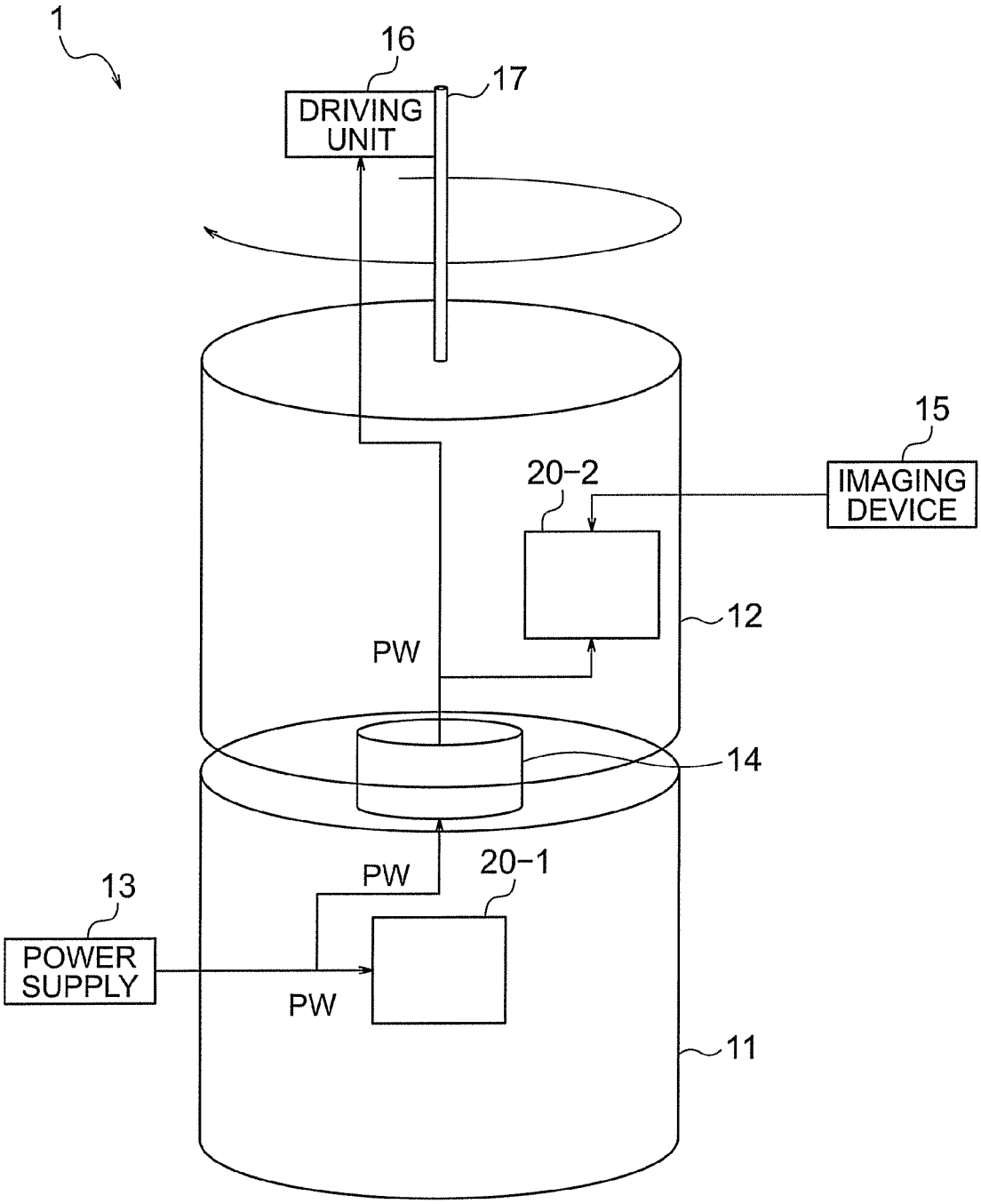
FIG. 1 is a schematic block diagram illustrating a configuration of a wireless communication device 1 in a first embodiment.

FIG. 1 is a schematic block diagram illustrating a configuration of a wireless communication device 1 in a first embodiment. As shown in FIG. 1, the wireless communication device 1 includes a fixed, first housing 11 and a first communication unit 20-1 arranged in the first housing 11. The wireless communication device 1 further includes a rotatable, second housing 12 and a second communication unit 20-2 fixed inside the second housing 12. This allows the second communication unit 20-2 to be rotated when the second housing 12 is rotated.

The wireless communication device 1 further includes the a slip ring 14 having a brush fixed to the first housing 11 and a rotating body fixed to the second housing 12, a driving part 16 connected with the slip ring 14, and a rotating shaft 17 connected with the driving part 16 and second housing.

The first communication unit 20-1 is supplied with power PW from a power supply 13. The first communication unit 20-1 communicates with the second communication unit 20-2, for example, at a millimeter-wave band (e.g., 60 GHz). The power supply 13 is AC 100 V or DC 24 V, for example.

A frequency used for communication may have a frequency exceeding a frequency band of millimeterwave.

The second communication unit 20-2 communicates with the first communication unit 20-1, for example, at a frequency of a millimeter waveband (e.g., 60 GHz). The second communication unit 20-2 acquires from an imaging device 15 image data obtained by way of imaging by the imaging device 15, for example. Then, the second communication unit 20-2 encodes the image data and modulates the encoded signal to generate a transmission signal, for example. Then, the second communication unit 20-2 transmits the generated transmission signal to the first communication unit 20-1.

In such a case, the first communication unit 20-1 receives the transmission signal transmitted from the second communication unit 20-2, demodulates the received signal, and decodes the demodulated signal.

The slip ring 14 is connected with the power supply 13, the driving part 16, and the second communication unit 20-2. The slip ring 14 receives supply of the power PW from the power supply 13, and supplies the received power PW to the driving part 16 and the second communication unit 20-2.

Specifically, the brush of the slip ring 14 receives supply of the power PW from the power supply 13. The brush of the slip ring 14 is brought into contact with a circular electrical path which is concentrically arranged with respect to the rotating body of the slip ring 14 so as to supply the power PW to the electrical path. The electrical path of the slip ring 14 is connected with the driving part 16 and the second communication unit 20-2, and the power PW is supplied to the driving part 16 and the second communication unit 20-2.

The driving part 16 uses the power PW supplied from the slip ring 14 to rotate the rotating shaft 17. This causes the second housing 12 fixed to the rotating shaft 17 to be rotated around the rotating shaft 17 so that the second communication unit 20-2 fixed inside the second housing 12 is also rotated around the rotating shaft 17.

Hereinafter, the first communication unit 20-1 and the second communication unit 20-2 are collectively referred to as a communication unit 20.

Figure 2:
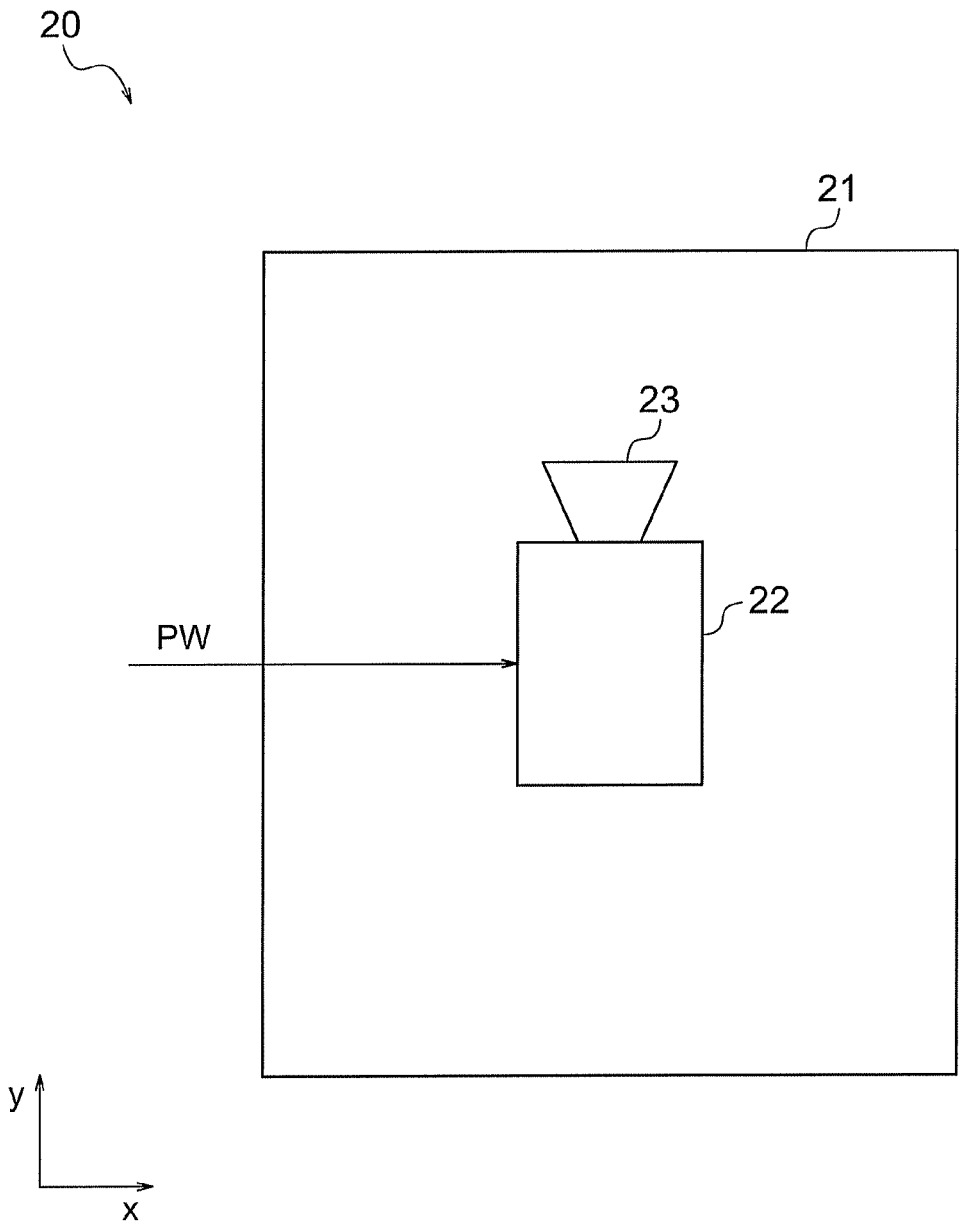
FIG. 2 is a schematic block diagram illustrating a configuration of the communication unit 20 in the first embodiment.

FIG. 2 is a schematic block diagram illustrating a configuration of the communication unit 20 in the first embodiment. As shown in FIG. 2, a board 21, a control part 22 arranged on the board, and an antenna 23 connected with the control part 22.

The control part 22 uses the supplied power PW to perform a modulation and encode process to generate the transmission signal, and supplies the generated transmission signal to the antenna 23. The control part 22 receives from the antenna 23 the transmission signal received by the antenna 23, and performs a demodulation and decode process on the received transmission signal. The control part 22 is an integrated circuit (IC), for example.

The antenna 23 receives from the control part 22 and wirelessly transmits the transmission signal. The antenna 23 receives the transmission signal wirelessly transmitted and supplies the received transmission signal to the control part 22. In the embodiment, the antenna 23 is a dipole antenna as an example.

Figure 3:
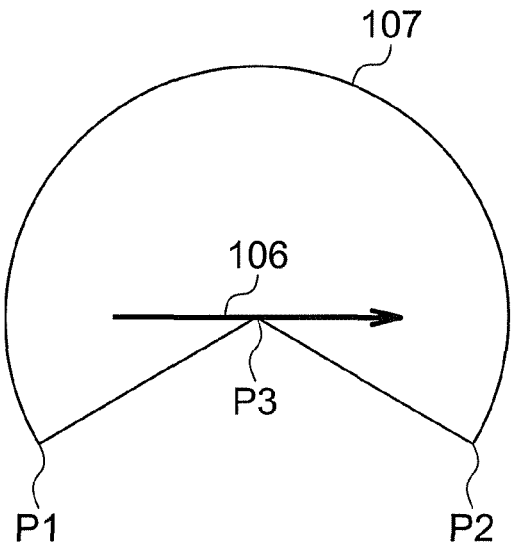
FIG. 3 is a diagram illustrating a symbol for a position of the antenna and an orientation of the antenna.

FIG. 3 is a diagram illustrating a symbol for a position of the antenna and an orientation of the antenna. A center of an arrow 106 is an installation position of the antenna. An orientation of the arrow 106 represents an orientation of a polarized wave from the dipole antenna.

Here, as shown by an area (communicable range) 107 representing a field emission angle range having an electric field intensity not less than that of a limit on communication, a field emission pattern is asymmetric about the antenna. This is because, as shown in FIG. 2, the control part 22 blocks an electric field such that the electric field is not emitted beyond the control part 22 owing to that the antenna 23 is connected with the control part 22.

One end P1 of an arc and the other end P2 of the arc of the communicable range 107, and an antenna center P3 are illustrated. Here, the one end and the other end of the arc of the communicable range 107 are referred to as area ends.

Figure 4:
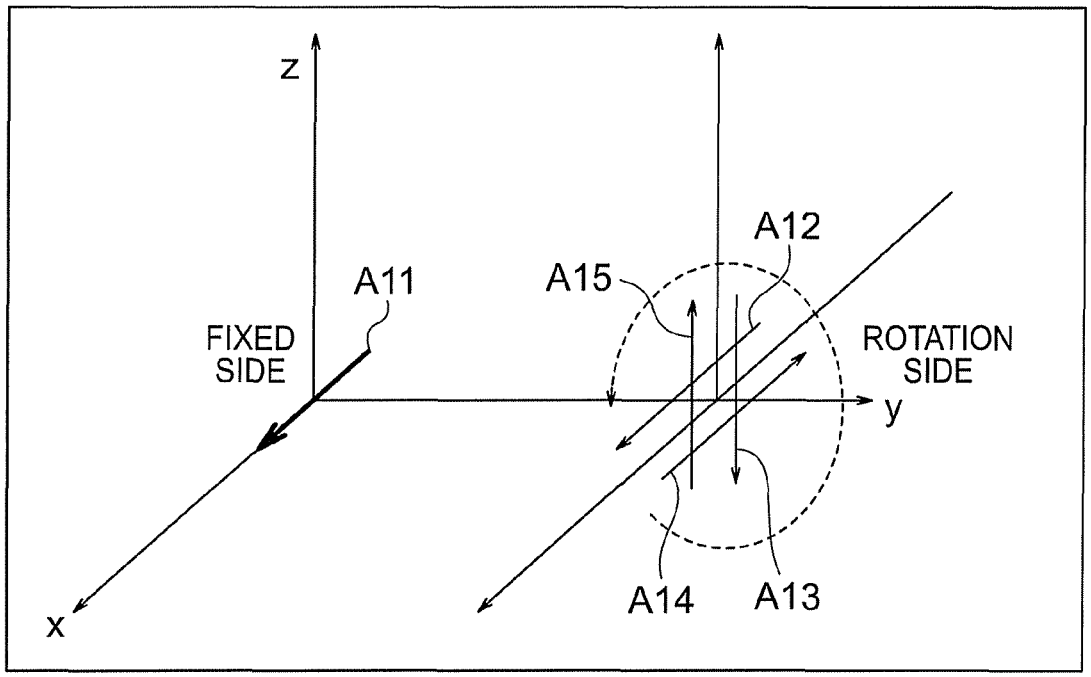
FIG. 4 is a diagram for illustrating an antenna arrangement according to a comparative example.

FIG. 4 is a diagram for illustrating an antenna arrangement according to a comparative example. As shown by an arrow A11, a fixed-side antenna is arranged along an axis x. Assuming that a rotation angle is 0 degrees when the orientations the fixed-side antenna and a rotation-side antenna coincide with each other. If the rotation angle is 0 degrees, the rotation-side antenna is positioned at an arrow A12 and arranged along the arrow A12, as an example. As the rotation-side antenna is rotated about the rotating shaft (y axis), the rotation-side antenna is to be positioned at arrows A13, A14, and A15 in this order, and to be arranged along the arrows A13, A14, and A15 in this order, for example.

Figure 5:
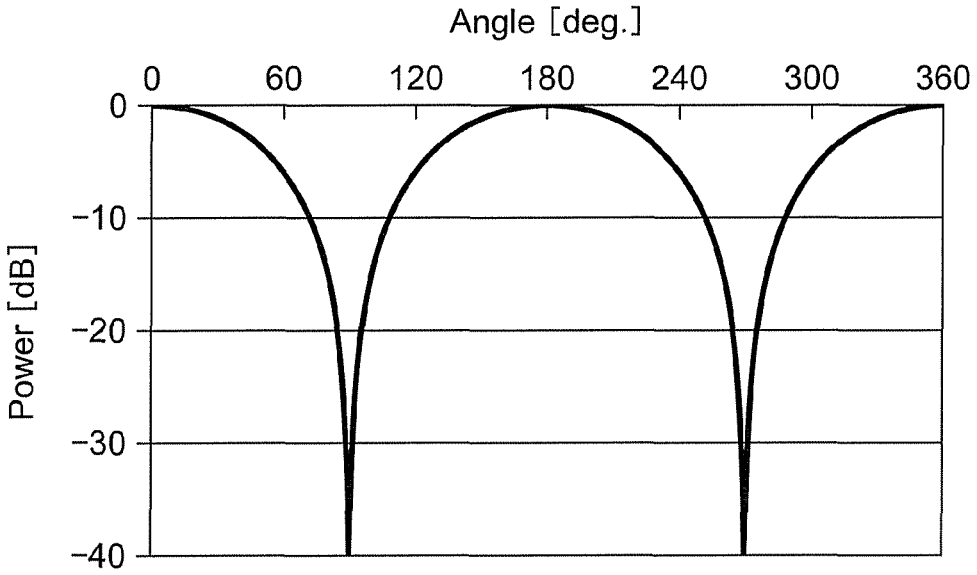
FIG. 5 is an example of a graph illustrating a relationship between the rotation angle of the rotation-side antenna and received power of the fixed-side antenna according to the comparative example.

FIG. 5 is an example of a graph illustrating a relationship between the rotation angle of the rotation-side antenna and received power of the fixed-side antenna according to the comparative example. A horizontal axis represents the rotation angle. As shown in FIG. 5, when the rotation angle is 90 degrees and 270 degrees, the received power is $-\infty$ dB, and communication between the rotation-side antenna and the fixed-side antenna is disabled. This is because when the rotation angle is 90 degrees and 270 degrees, if a linearly-polarized wave from the rotation-side antenna is completely contained in a plane perpendicular to a linearly-polarized wave from the fixed-side antenna, components parallel to the linearly-polarized wave from the fixed-side antenna are cancelled in the electric field generated at a position of the fixed-side antenna by the rotation-side antenna.

Figure 6A:
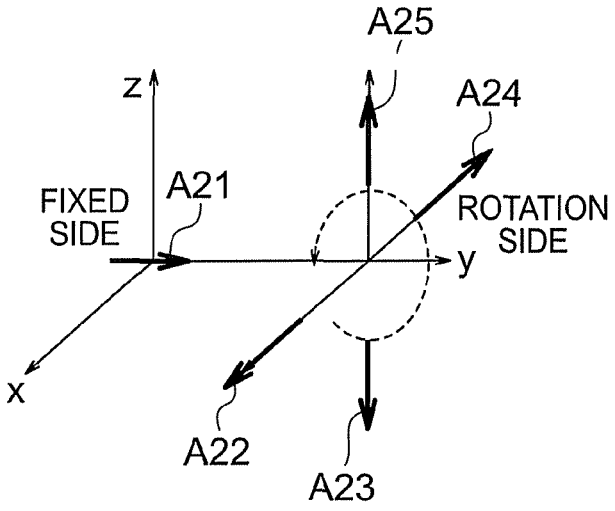
FIG. 6A is a diagram for illustrating antenna arrangements in the first embodiment.

FIG. 6A is a diagram for illustrating an antenna arrangement according to the first embodiment. As shown by an arrow A21, the antenna 23 of the fixed, first communication unit 20-1 (hereinafter, referred to as a first antenna) is arranged along the rotating shaft (y axis). As the antenna 23 of the rotated, second communication unit 20-2 (hereinafter, referred to as a second antenna) is rotated along the rotating shaft (y axis), for example, every time when the second antenna is rotated by 90 degrees, it is arranged along arrows A22 to A25. Here, in each embodiment of this and subsequent embodiments, the second communication unit 20-2 transmits the image data to the first communication unit 20-1, as an example. For this reason, in each embodiment of this and subsequent embodiments, the first antenna is a receiving antenna and the second antenna is a transmitting antenna, as an example.

The first antenna may perform at least one of transmission and reception of an electromagnetic wave to and from the second antenna.

The second antenna may perform at least one of transmission and reception of an electromagnetic wave to and from the first antenna.

Figure 6B:
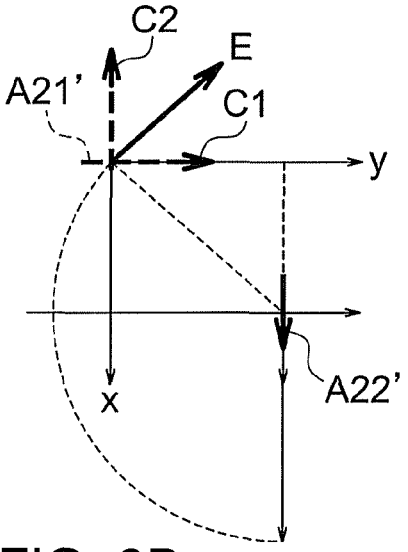
FIG. 6B is another diagram for illustrating antenna arrangements in the first embodiment.

FIG. 6B is a diagram for illustrating an antenna arrangement in which the second antenna is in an x-y two-dimensional space during rotation in the first embodiment. An arrow A21' corresponds to the arrow A21 in FIG. 6A. As shown by the arrow A21', the fixed, first antenna is arranged along the rotating shaft (y axis). An arrow A22' corresponds to the arrow A22 in FIG. 6A. As shown by the arrow A22', the rotating second antenna is arranged at a position apart from the rotating shaft (y axis) and in parallel to the x axis.

An electric field E generated at the position of the first antenna by the second antenna is shown. There are shown a component (polarized wave matching component) C1 parallel to the orientation of the first antenna and a component (polarized wave mismatching component) C2 perpendicular to the orientation of the first antenna in the electric field E. Since the polarized wave matching component is not zero, the first antenna and the second antenna are communicable with each other at least in terms of the polarized wave.

Figure 7:
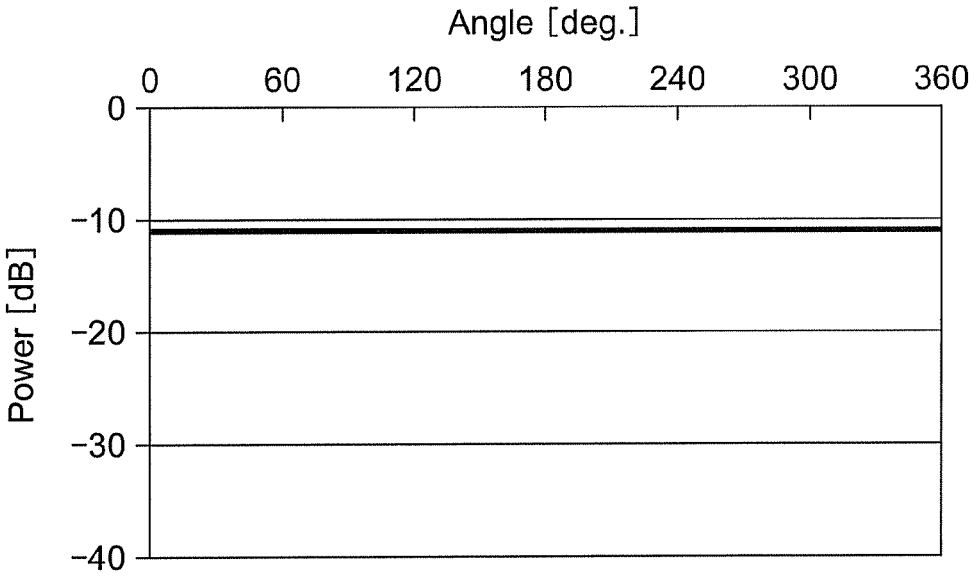
FIG. 7 is an example of a graph illustrating a relationship between the rotation angle of the second antenna and the received power of the first antenna according to the first embodiment.

FIG. 7 is an example of a graph illustrating a relationship between the rotation angle of the second antenna and the received power of the first antenna according to the first embodiment. There is shown that the received power of the first antenna is constant independent of the rotation angle of the second antenna. This is because even if the second antenna is rotated about the rotating shaft, the component (polarized wave matching component) parallel to the orientation of the polarized wave from the first antenna is constant in the components of the electric field generated at the position of the first antenna by the second antenna.

Since the first embodiment assumes the communication in a far field, a distance between the first antenna and the second antenna is equal to or more than a critical distance L which is determined based on an aperture length D1 of the first antenna, an aperture length D2 of the second antenna, and a wavelength "λ" (=c/f, where "c" is a light speed) at a communication frequency "f" between the first antenna and the second antenna. Specifically, the critical distance L is expressed by the following formula (1).

$$L=2(D1+D2)^2/\lambda \quad (1)$$

In the embodiment, the aperture length D1 of the first antenna and the aperture length D2 of the second antenna are one half of the wavelength "λ" at this communication frequency "f," as an example. When D1=λ/2 and D2=λ/2 are assigned to the formula (1), the critical distance "L" is 2λ. Therefore, a distance between the first antenna and the second antenna is equal to or larger than twice the wavelength "λ" at this communication frequency "f," as an example. In each embodiment below, as an example, the distance between the first antenna and the second antenna is equal to or larger than twice the wavelength"λ" at this communication frequency "f."

The communication frequency for the first antenna and the second antenna is a frequency band of millimeter waves, as an example. In each embodiment below, the communication frequency for the first antenna and second antenna is a frequency band of millimeter waves, as an example.

For example, the communication frequency is 60 GHz and the wavelength is 5 mm. Here, in order to meet a condition for the far field, the antennas need to be separated from each other by two wavelengths or more. However, this two wavelengths is short length (e.g., 10 mm), and thus the wireless communication device 1 can be reduced in size.

As described above, in the first embodiment, the first antenna is arranged on and along the rotating shaft about which the second antenna is rotated, as an example. The second antenna is arranged at a position apart from the rotating shaft perpendicularly to the rotating shaft. This leads to that even if the second antenna is rotated about the rotating shaft, the component (polarized wave matching component) parallel to the orientation of the polarized wave from the first antenna is constant in the components of the electric field generated at the position of the first antenna by the second antenna. As a result, the received power of the first antenna is constant independent of the rotation angle of the second antenna, allowing the stable communication. Therefore, quality of the signal can be improved when the signal is transmitted at a high speed between the first housing 11 and the second housing 12.

Second Embodiment

In a second embodiment, the first antenna has a predetermined angle with respect to the rotating shaft when the second antenna is rotated, differently from the first embodiment. Note that a configuration of the wireless communication device 1 in the second embodiment is the same as the wireless communication device 1 in the first embodiment shown in FIG. 1, and a description thereof is omitted.

Subsequently, a description is given of an example of an antenna arrangement and a communication state according to the first embodiment with reference to FIG. 8.

Figure 8:
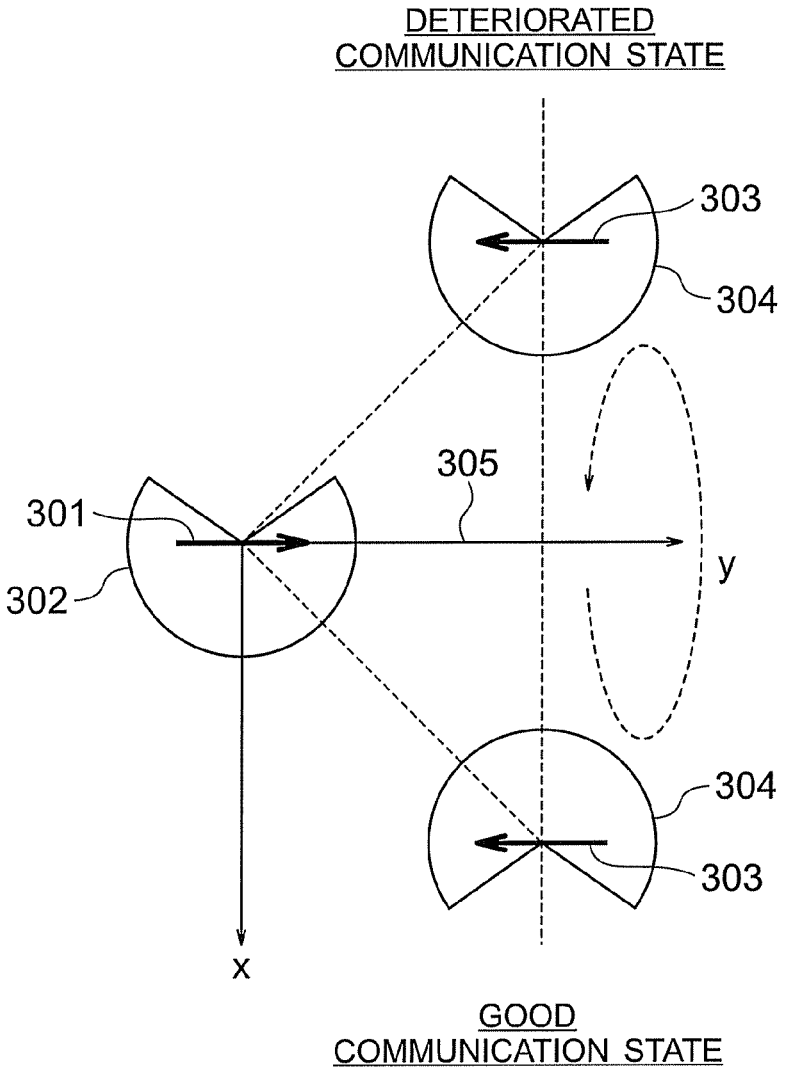
FIG. 8 is a diagram for illustrating the antenna arrangement and the communication state according to the first embodiment.

FIG. 8 is a diagram for illustrating the antenna arrangement and the communication state according to the first embodiment. The figure shows an example of two cases where the rotating, second antenna is on the x-y plane. There are shown an arrow 301 indicating the position and the orientation of the first antenna and an arrow 303 indicating the position and the orientation of the second antenna. There are also shown a communicable range 302 for the first antenna 301 and a communicable range 304 for the second antenna 303.

The first antenna is arranged in parallel to a rotating shaft (y axis) 305 about which the second antenna is rotated. The second antenna is arranged at a position apart from the rotating shaft (y axis) 305 and in parallel to the rotating shaft (y axis) 305.

As an example, the control part 22 blocks the electric field emitted by the first antenna such that the field emission pattern derived from the first antenna has a field emission pattern asymmetric about an element axis (asymmetric orientation). There is shown that the communicable range 302 is asymmetric as a result thereof. Similarly, as an example, the control part 22 blocks the electric field emitted by the second antenna such that a field emission pattern derived from the second antenna has an asymmetric field emission pattern (asymmetric orientation). There is shown that the communicable range 304 is asymmetric as a result thereof. The second antenna is rotated about the rotating shaft (y axis) 305.

When the second antenna is put at a positive position on the x axis, a line connecting the position of the first antenna and the position of the second antenna intersects with an arc of the communicable range 302. Therefore, a communication state is good.

On the other hand, when the second antenna is put at a negative position on the x axis, a line connecting the position of the first antenna and the position of the second antenna does not intersect with the arc of the communicable range 302. Therefore, the communication state is deteriorated. In this way, since antenna directivity is asymmetric, the second antenna has a deteriorated communication state at some rotation angles in some cases. In other words, depending on the field emission pattern derived from the first antenna and the distance between the rotating shaft and the second antenna apart from each other, there are the rotation angles at which a stable communication is disabled in some cases.

Therefore, in the second embodiment, the first antenna has a predetermined angle with respect to the rotating shaft when the second antenna is rotated such that the communication state between the first antenna and the second antenna can be kept good independent of the rotation angle of the second antenna, allowing equalization of the communication state. Here, the equalization means that a difference between the maximum value and the minimum value of communication sensitivity is decreased.

Figure 9:
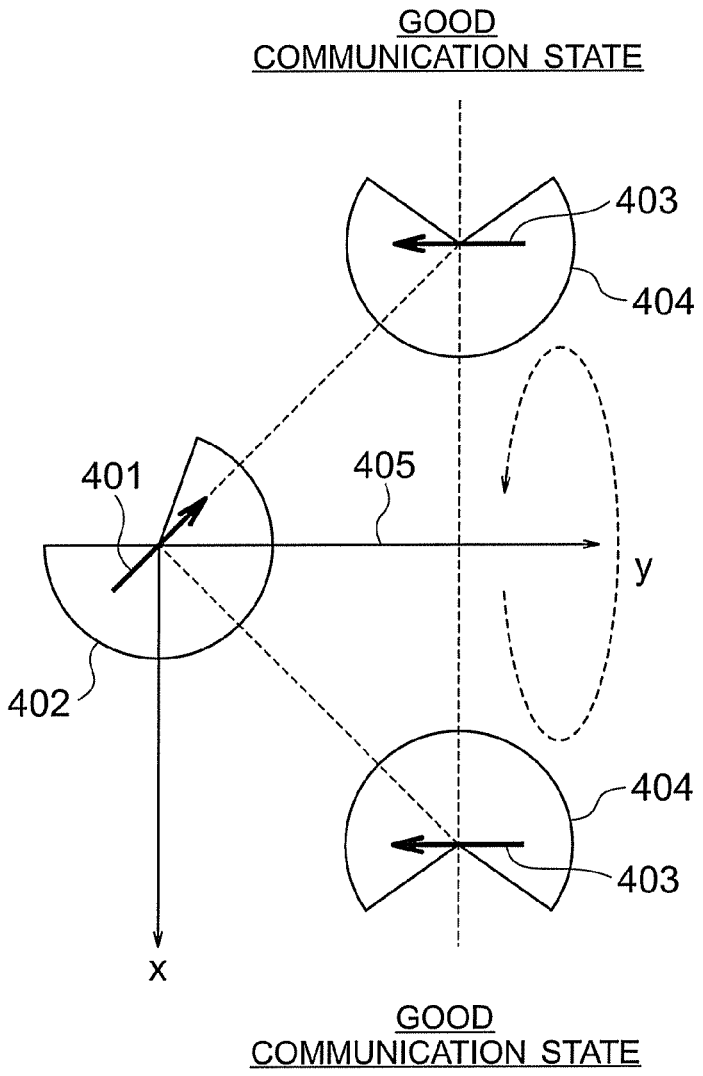
FIG. 9 is a diagram for illustrating the antenna arrangement and the communication state according to the second embodiment.

Here, a description is given of an example of an antenna arrangement and a communication state according to the second embodiment with reference to FIG. 9.

FIG. 9 is a diagram for illustrating the antenna arrangement and the communication state according to the second embodiment. The figure shows an example of two cases where the rotating, second antenna is on the x-y plane. There are shown an arrow 401 indicating the position and the orientation of the first antenna and an arrow 403 indicating the position and the orientation of the second antenna. There are also shown a communicable range 402 for the first antenna and a communicable range 404 for the second antenna. In this way, the field emission pattern of the first antenna is asymmetric about the rotating shaft when the second antenna revolves along a predetermined orbit.

The first antenna is arranged on a rotating shaft (y axis) 405 at a predetermined angle other than a right angle to the rotating shaft (y axis) 405 about which the second antenna is rotated.

The first antenna may be arranged at a position apart from the rotating shaft (y axis) 405.

In the second embodiment, as an example, the first antenna is not perpendicular to the rotating shaft 405. The reason for this is in order to prevent a situation as below: When the first antenna is arranged perpendicularly to the rotating shaft 405, the polarized wave thereof is also perpendicular to the rotating shaft 405. Accordingly, when the second antenna is rotated to be positioned on a plane rotated by 90 degrees with respect to the x-y plane in FIG. 9, the polarized wave from the first antenna and the polarized wave from the second antenna are completely perpendicular to each other.

The second antenna is arranged at a position apart from the rotating shaft (y axis) 405 and in parallel to the rotating shaft (y axis) 405, as an example. The second antenna may be arranged at a predetermined angle that is not in parallel to the rotating shaft 405. In the embodiment, the second antenna is apart from the rotating shaft 405 as an example, but may be arranged on the rotating shaft 405. In this case also, it is sufficient so long as the first antenna is arranged on the x-y plane at a predetermined angle other than a right angle to the rotating shaft 405. This leads to that even if the second antenna is rotated, the polarized wave from the first antenna and the polarized wave from the second antenna are not perpendicular to each other, enabling the communication between the antennas.

There is shown that the field emission pattern derived from the first antenna is an asymmetric field emission pattern (asymmetric orientation), and the communicable range 402 is asymmetric. Similarly, there is shown that the field emission pattern derived from the second antenna is an asymmetric field emission pattern (asymmetric orientation), and the range 404 having an electric field intensity not less than that of a limit on communication is asymmetric. The second antenna is rotated about the rotating shaft (y axis) 405.

When the second antenna is put at a positive position on the x axis as well as when at a negative position on the x axis, the second antenna enters a field emission area of the first antenna. This allows the communication state between the first antenna and the second antenna to be kept good independent of the rotation angle of the second antenna, allowing equalization of the communication state.

As described above, in the second embodiment, the first antenna is arranged at a predetermined angle to the rotating shaft 405. This leads to that even if the second antenna is rotated about the rotating shaft 405, the polarized wave from the first antenna and the polarized wave from the second antenna are not perpendicular to each other. As a result, the communication state between the first antenna and the second antenna can be kept good independent of the rotation angle of the second antenna, allowing equalization of the communication state.

Third Embodiment

In a third embodiment, arrangement is made such that a maximum communication sensitivity direction of the second antenna is directed to a direction of the first antenna, in addition to the second embodiment. Note that a configuration of the wireless communication device 1 in the third embodiment is the same as the wireless communication device 1 in the first embodiment shown in FIG. 1, and a description thereof is omitted.

Figure 10:
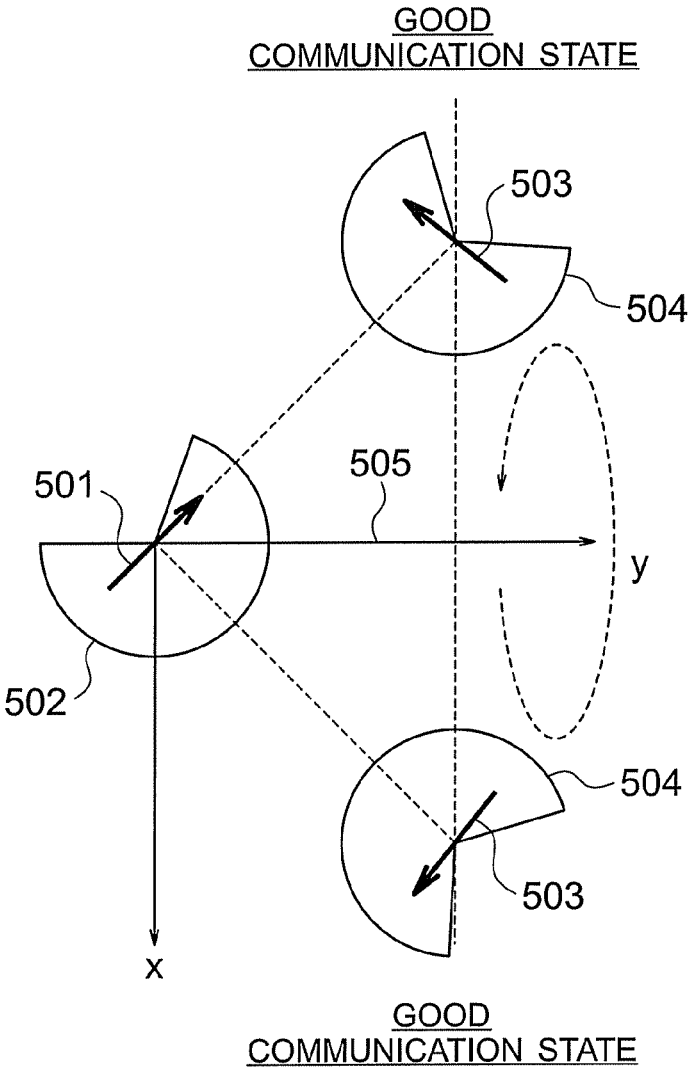
FIG. 10 is a diagram for illustrating an antenna arrangement and a communication state according to the third embodiment.

FIG. 10 is a diagram for illustrating an antenna arrangement and a communication state according to the third embodiment. The figure shows the arrangements of the first antenna and second antenna in two cases where the rotating, second antenna is on the x-y plane. There are shown an arrow 501 indicating the position and the orientation of the first antenna and an arrow 503 indicating the position and the orientation of the second antenna. There are also shown a communicable range 502 for the first antenna and a communicable range 504 for the second antenna.

The first antenna is arranged on a rotating shaft (y axis) 505 and at a predetermined angle other than a right angle to the rotating shaft (y axis) 505 about which the second antenna is rotated.

The second antenna is arranged at a position at a predetermined distance from the rotating shaft 505 such that the maximum communication sensitivity direction of the second antenna is directed to the direction of the first antenna. In the embodiment, as an example, since the first antenna is put on the rotating shaft 505, an angle formed by a line through the first antenna and the second antenna and the y axis is always constant. Therefore, the maximum communication sensitivity direction of the second antenna is directed to the direction of the first antenna to allow the communication always with good sensitivity independent of the rotation angle of the second antenna.

Fourth Embodiment

In a fourth embodiment, a separation distance between the rotating shaft and the second antenna is a distance which is a limit of the communicable range for the first antenna, which is different from the third embodiment in comparison. Note that a configuration of the wireless communication device 1 in the fourth embodiment is the same as the wireless communication device 1 in the first embodiment shown in FIG. 1, and a description thereof is omitted.

Figure 11:
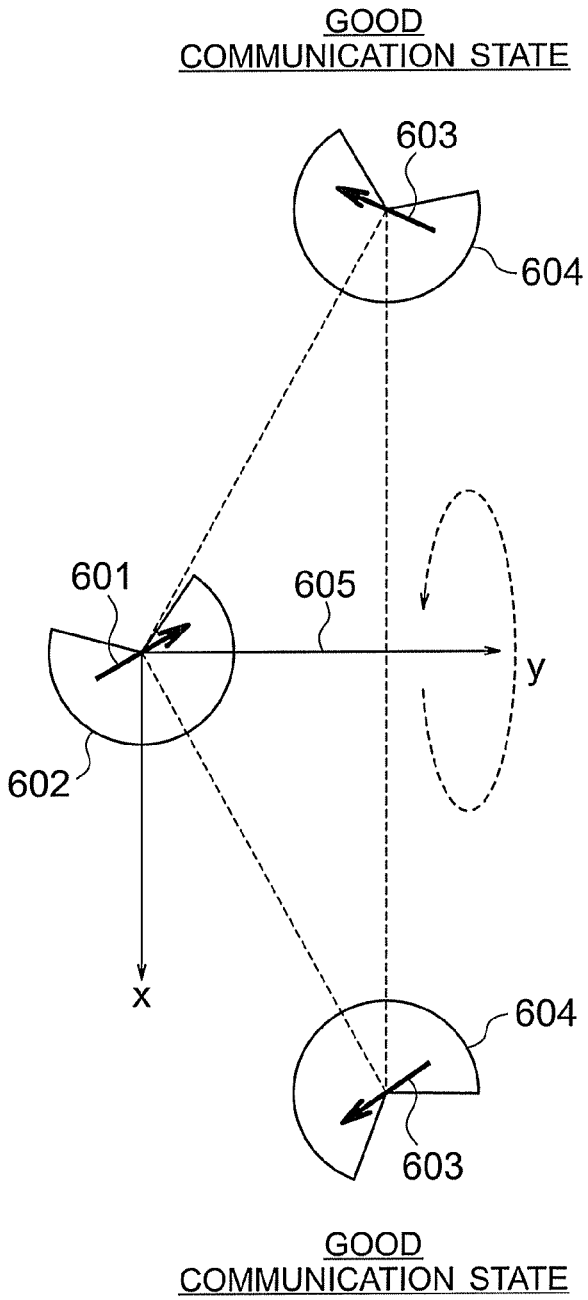
FIG. 11 is a diagram for illustrating an antenna arrangement and a communication state according to the fourth embodiment.

FIG. 11 is a diagram for illustrating an antenna arrangement and a communication state according to the fourth embodiment. The figure shows the arrangements of the first antenna and second antenna in two cases where the rotating, second antenna is on the x-y plane. There are shown an arrow 601 indicating the position and the orientation of the first antenna and an arrow 603 indicating the position and the orientation of the second antenna. There are also shown a communicable range 602 for the first antenna and a communicable range 604 for the second antenna.

The first antenna is arranged on a rotating shaft (y axis) 605 and at a predetermined angle other than a right angle to the rotating shaft (y axis) 605 about which the second antenna is rotated.

The second antenna, similarly to the third embodiment, is arranged at a position apart from the rotating shaft 605 such that the maximum communication sensitivity direction is directed to the direction of the first antenna. Furthermore, in FIG. 11, when the second antenna is on the negative side in the x axis, the second antenna is positioned in a direction of communicable limit angle of the first antenna.

This allows the second antenna to be arranged at a position on the limit of the enough communication sensitivity of the first antenna.

Figure 12:
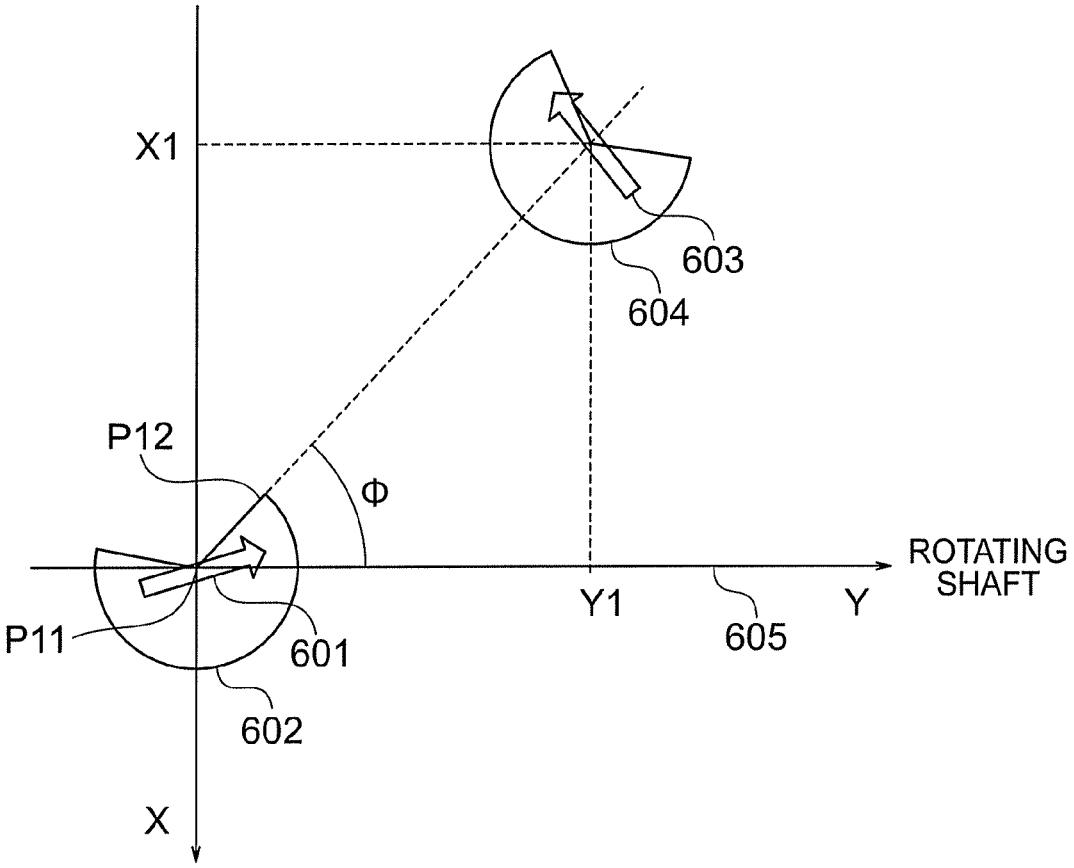
FIG. 12 is a diagram for illustrating a separation distance between the rotating shaft 605 and the second antenna in FIG. 11.

FIG. 12 is a diagram for illustrating a separation distance between the rotating shaft 605 and the second antenna in FIG. 11. The figure shows an example of a case where the rotating, second antenna is on the negative side of the x axis on the x-y plane. There are shown an arrow 601 indicating the position and the orientation of the first antenna and an arrow 603 indicating the position and the orientation of the second antenna. There are also shown a communicable range 602 for the first antenna and a communicable range 604 for the second antenna.

The separation distance between the second antenna and the rotating shaft 605 is a distance |X1| determined based on an angle "ϕ" and a distance Y1 between the first antenna and the second antenna along the rotating shaft 605, the angle "ϕ" being formed by a line connecting an antenna center P11 of the first antenna and one end (area end) P12 of an arc of the communicable range 602, and the rotating shaft 605. Specifically, this distance |X1| is expressed by the next formula (2).

$$|X1|=Y1\times\tan\phi \quad (2)$$

As described above, in the fourth embodiment, the separation distance between the second antenna and the rotating shaft 605 is the distance |X1| determined based on the angle "ϕ" and the distance Y1 between the first antenna and the second antenna along the rotating shaft 605, the angle "ϕ" being formed by a line connecting the antenna center P11 of the first antenna and the one end (area end) P12 of the arc of the communicable range 602, and the rotating shaft 605. This makes it possible to arrange the second antenna at the maximum distance from the rotating shaft 605 in a range of the enough communication sensitivity of the first antenna. Therefore, the component (polarized wave matching component) parallel to the orientation of the polarized wave from the first antenna can be made maximum in the electric field generated at the position of the first antenna by the second antenna. As a result, the received power of the first antenna can be improved.

In the embodiment, the separation distance between the second antenna and the rotating shaft 605 is |X1|, but, without limited thereto, it may be sufficient so long as the separation distance between the second antenna and the rotating shaft 605 is equal to or less than the distance |X1|. This allows the separation distance between the second antenna and the rotating shaft 605 to fall within the range of the enough communication sensitivity of the first antenna and allows a degree of freedom of the second antenna arrangement to be improved.

Fifth Embodiment

In a fifth embodiment, the first antenna is separated from the rotating shaft in a direction in which the field emission intensity of the first antenna is smaller than a predetermined value, which is different from the fourth embodiment in comparison. Note that a configuration of the wireless communication device 1 in the fifth embodiment is the same as the wireless communication device 1 in the first embodiment shown in FIG. 1, and a description thereof is omitted.

Figure 13:
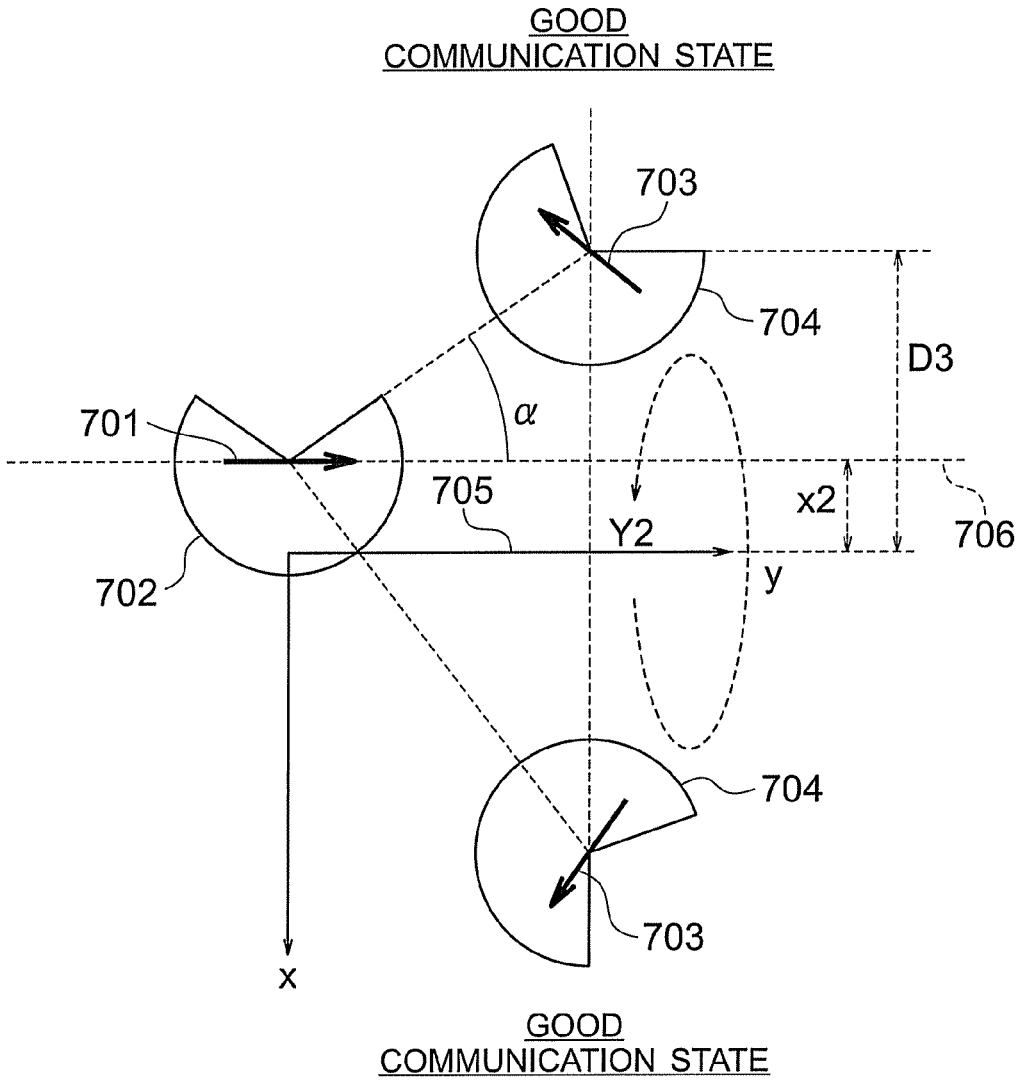
FIG. 13 is a diagram for illustrating an antenna arrangement and a communication state according to the fifth embodiment.

FIG. 13 is a diagram for illustrating an antenna arrangement and a communication state according to the fifth embodiment. The figure shows an example of two cases where the rotating, second antenna is on the x-y plane. There are shown an arrow 701 indicating the position and the orientation of the first antenna and an arrow 703 indicating the position and the orientation of the second antenna. There are also shown a communicable range 702 for the first antenna and a communicable range 704 for the second antenna. In this way, the field emission pattern of the first antenna is asymmetric about a rotating shaft 705 when the second antenna revolves along a predetermined orbit.

The first antenna is arranged at a position apart from the rotating shaft 705 about which the second antenna is rotated, in a direction determined based on the field emission pattern derived from the first antenna. As an example thereof, in FIG. 13, the first antenna is arranged at a position apart in a vertical direction from the rotating shaft 705 when the second antenna is rotated. This allows the second antenna to fall within in a range of the first antenna directivity even if being on the position of the arrow 701, and therefore the communication state between the first antenna and the second antenna is good.

Since the field emission pattern of the first antenna is asymmetric about the rotating shaft 705 when the second antenna is rotated, the first antenna may be arranged in a direction of a low field emission from the first antenna with respect to the rotating shaft 705 (here, in the negative direction on the x axis, as an example).

The first antenna is arranged in parallel to the rotating shaft (y axis) 705. The first antenna may be arranged at a predetermined angle other than a right angle to the rotating shaft (y axis) 705.

The second antenna, similarly to the third and fourth embodiments, is arranged at a position apart from the rotating shaft 705 such that the maximum communication sensitivity direction is directed to the direction of the first antenna.

The separation distance between the second antenna and the rotating shaft 705 is a distance D3 determined based on an angle "α," a separation distance x2 between the first antenna and the rotating shaft 705, and a distance Y2 between the first antenna and the second antenna along the rotating shaft 705, the angle "α" being formed by a line which passes through an antenna center of the first antenna and which extends to a direction of communicable limit angle of the first antenna, and a line 706 through the first antenna and parallel to the rotating shaft 705. Specifically, this distance D3 is expressed the next formula (3).

$$D3=Y2\times\tan\alpha+x2 \quad (3)$$

The separation distance between the second antenna and the rotating shaft 705 may be equal to or less then the distance D3.

As in FIG. 13, the fixed first antenna is separated (offset) from the rotating shaft in the x axis direction to allow the communication state to be kept in a good state while the second antenna revolves and the communication sensitivity (received power) to be equalized during the revolving.

Figure 14:
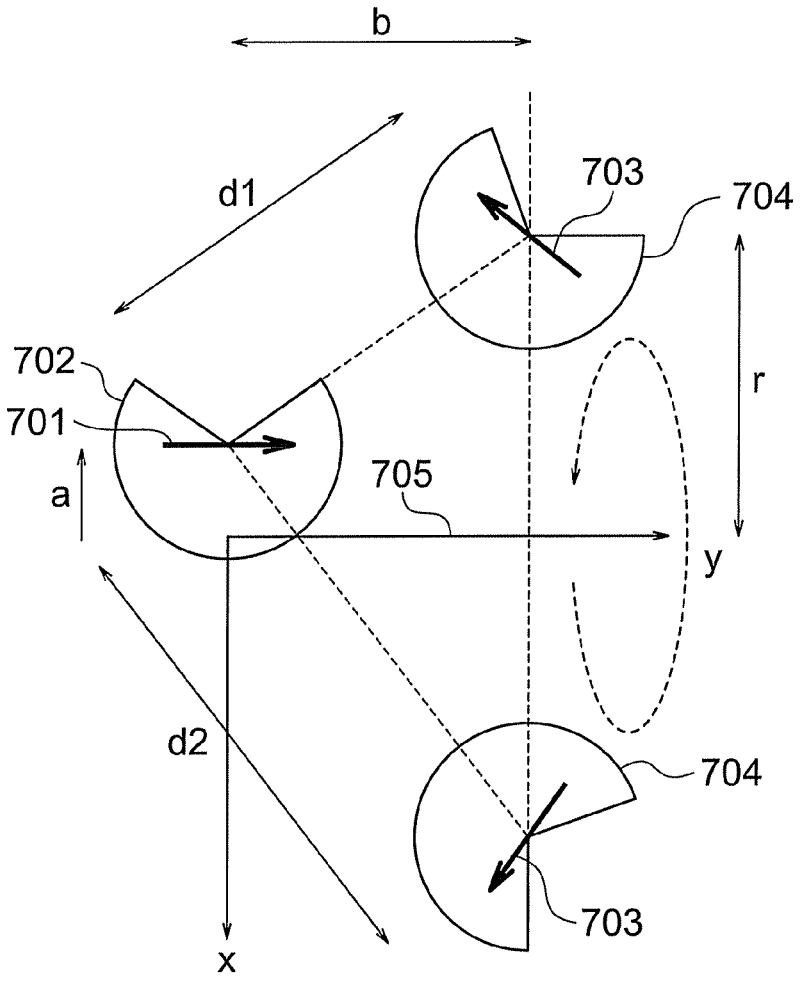
FIG. 14 is a diagram for illustrating a distance "a" between the first antenna and the rotating shaft 705.

Subsequently, a description is given of an example of a distance between the first antenna and the rotating shaft 705 with reference to FIG. 14. FIG. 14 is a diagram for illustrating a distance "a" between the first antenna and the rotating shaft 705. The figure shows distances relating to the first antenna and the second antenna in two cases where the rotating, second antenna is on the x-y plane.

In the figure, there are shown the distance "a" between the first antenna and the rotating shaft 705, a distance "b" between the first antenna and the second antenna along the rotating shaft (y axis) (hereinafter, referred to as a horizontal distance), and a distance "r" between the second antenna and the rotating shaft 705 (hereinafter, also referred to as a gyration radius). There is also shown a distance d1 between the first antenna and the second antenna in the case where the second antenna is on the negative side of the x axis (hereinafter, also referred to as a shortest distance between antennas). There is also shown a distance d2 between the first antenna and the second antenna in the case where the second antenna is on the positive side of the x axis (hereinafter, also referred to as a longest distance between antennas).

The shortest distance between antennas d1 and the longest distance between antennas d2 are expressed by the next formulas (4) and (5), respectively.

$$d1=\sqrt{((r-a)^2+b^2)} \quad (4)$$

$$d2=\sqrt{((r+a)^2+b^2)} \quad (5)$$

As described above, assuming that a wavelength at the communication frequency between the first antenna and the second antenna is "λ," a minimum value L1 and a maximum value L2 of propagation loss after the offset are expressed by the next formulas (6) and (7), respectively.

$$L1=20\ \log(4\pi d1/\lambda) \quad (6)$$

$$L2=20\ \log(4\pi d2/\lambda) \quad (7)$$

Therefore, in a case of offsetting the first antenna in the x axis direction by the distance "a," an equalization amount "Ave" of the received power is expressed by the next formula (8).

$$Ave=L2-L1=20\ \log(d2/d1) \quad (8)$$

For example, assuming that a minimum received power is P1 in the case of not offsetting the first antenna from the rotating shaft 705 and a maximum received power is P2 in the case of not offsetting the first antenna.

When Ave=P2−P1 is assigned to the formula (8), the next formula (9) is found.

$$P2-P1=20\ \log(d2/d1) \quad (9)$$

Furthermore, when the formula (4) and the formula (5) are assigned to the formula (9), the distance "a" between the first antenna and the rotating shaft 705 is found.

Therefore, the distance between the first antenna and the rotating shaft 705, as an example, is determined based on the minimum received power P1 and the maximum received power P2, the distance "b" between the first antenna and the second antenna along the rotating shaft 705, and the distance (gyration radius) "r" between the second antenna and the rotating shaft 705, the powers P1 and P2 of the first antenna in the case where the first antenna is arranged at a point at which a perpendicular line from the first antenna to the rotating shaft 705 intersects with the rotating shaft 705.

This can decrease a difference between a minimum received power and a maximum received power in the second antenna.

As described above, in the fifth embodiment, the first antenna is arranged at a position apart from the rotating shaft 705 about which the second antenna is rotated, in a direction of a low communication sensitivity of the first antenna. Here, the communication sensitivity is proportional to the square of the distance between the antennas, but this arrangement can decrease a difference between the minimum received power and the maximum received power in the second antenna.

Furthermore, the distance between the first antenna and the rotating shaft 705, as an example, is determined based on the minimum received power P1 and the maximum received power P2, the distance "b" between the first antenna and the second antenna along the rotating shaft 705, and the distance (gyration radius) "r" between the second antenna and the rotating shaft 705, the powers P1 and P2 of the first antenna in the case where the first antenna is arranged at the point at which the perpendicular line from the first antenna to the rotating shaft 705 intersects with the rotating shaft 705. This allows the communication sensitivity (received power) of the second antenna to be constant independent of the rotation angle of the second antenna.

Sixth Embodiment

In a sixth embodiment, the first antenna is arranged at a position apart from the rotating shaft and the second antenna is arranged on the rotating shaft, which is different from the fourth embodiment in comparison. Note that a configuration of the wireless communication device 1 in the sixth embodiment is the same as the wireless communication device 1 in the first embodiment shown in FIG. 1, and a description thereof is omitted.

Figure 15A:
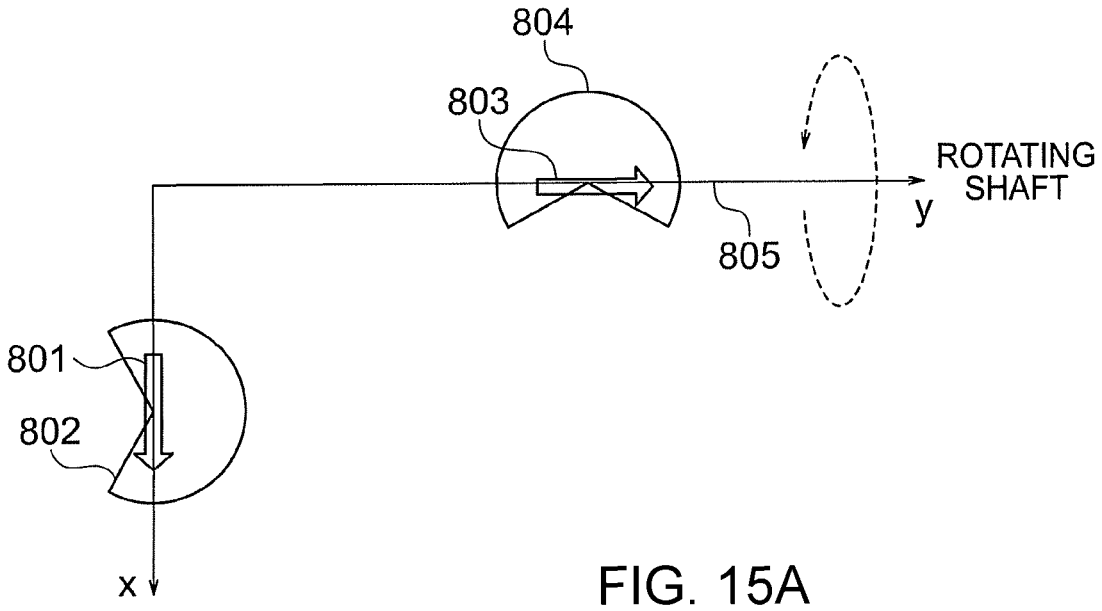
FIG. 15A is an example of the antenna arrangements in the sixth embodiment.

FIG. 15A is an example of the antenna arrangement in a case where the rotation angle of the second antenna is 0 degrees in the sixth embodiment. The figure shows an example in which a fixed first antenna 801 and a second antenna 803 rotating about a rotating shaft 805. There are shown an arrow 801 indicating the position and the orientation of the first antenna and an arrow 803 indicating the position and the orientation of the second antenna. There are shown a communicable range 802 for the first antenna and a communicable range 804 for the second antenna. In this way, the field emission pattern of the first antenna is asymmetric about the rotating shaft when the second antenna is rotated at a predetermined position.

The first antenna is arranged at a position apart from the rotating shaft (y axis) 805 in the x axis direction and in parallel to the x axis, as an example. The first antenna may be arranged at a predetermined angle not in parallel to the x axis.

The second antenna is arranged in parallel to the rotating shaft (y axis) 805. In a case where the first antenna is arranged in parallel to the x axis as shown in FIG. 15A, the second antenna may be arranged at a predetermined angle not in parallel to the rotating shaft (y axis) 805.

Figure 15B:
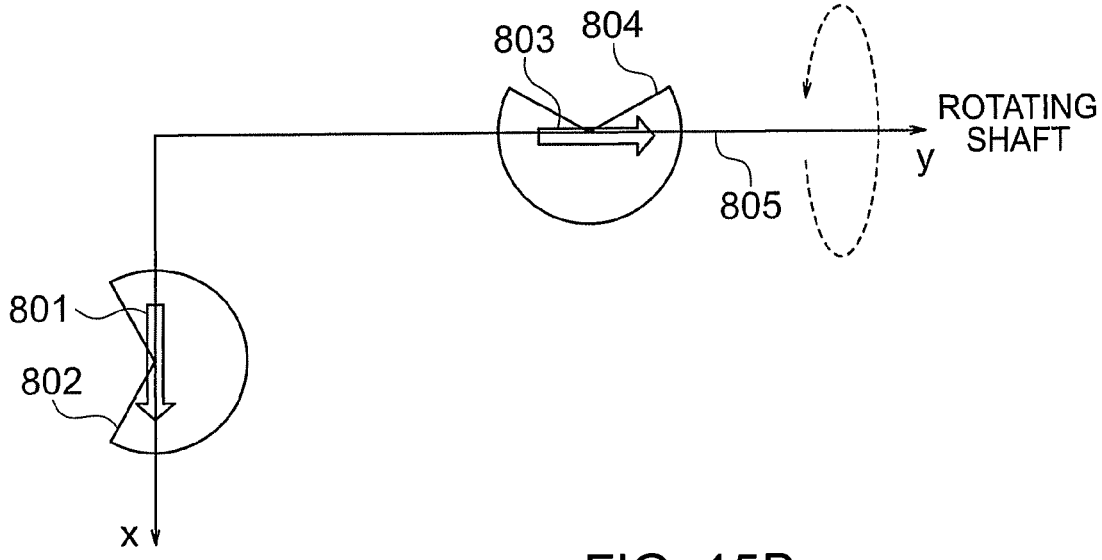
FIG. 15B is another example of the antenna arrangements in the sixth embodiment.

FIG. 15B is an example of the antenna arrangement in a case where the rotation angle of the second antenna is 180 degrees in the sixth embodiment. In comparison with FIG. 15A, the communicable range 804 for the second antenna is rotated by 180 degrees. This is because the second antenna is rotated with respect to the rotating shaft by 180 degrees.

Figure 16:
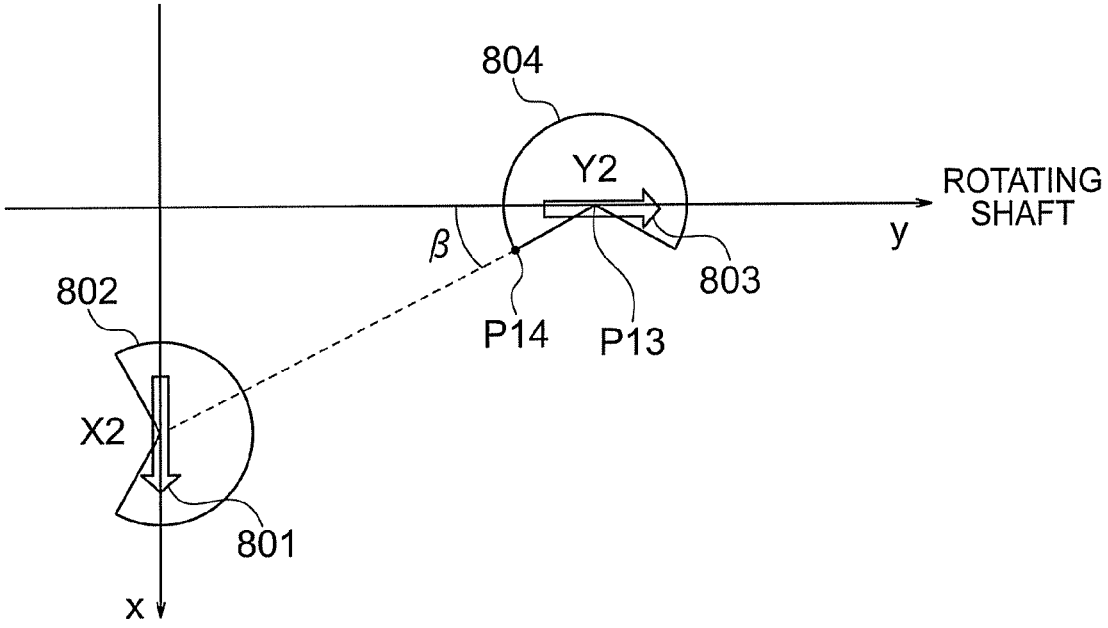
FIG. 16 is a diagram for illustrating the separation distance between the first antenna and the rotating shaft 805 in FIG. 15A.

Subsequently, a description is given of a separation distance between the first antenna and the rotating shaft with reference to FIG. 16. FIG. 16 is a diagram for illustrating the separation distance between the first antenna and the rotating shaft 805 in FIG. 15A. The figure shows the positions of the first antenna and the second antenna in the case of the rotation angle of 0 degrees, similarly to FIG. 15A. There are also shown the communicable range 802 for the first antenna and the communicable range 804 for the second antenna. There are also shown an antenna center P13 of the second antenna and one end (area end) P14 of an arc contained in the communicable range 804 for the second antenna.

The separation distance between the first antenna and the rotating shaft 805 is a distance X2 determined based on an angle "β," and a distance Y2 between the first antenna and the second antenna along the rotating shaft 805, the angle "β" being formed by a line connecting the antenna center P13 of the second antenna and the one end (area end) P14 of the arc of the communicable range 802, and the rotating shaft 805. Specifically, this distance X2 is expressed by the next formula (10)

$$X2=Y2\times\tan\beta \tag{10}$$

As described above, in the sixth embodiment, the separation distance between the first antenna and the rotating shaft 805 is a distance X2 determined based on an angle "β," and a distance Y2 between the first antenna and the second antenna along the rotating shaft 805, the angle "β" being formed by a line connecting the antenna center P13 of the second antenna and the one end (area end) P14 of the arc of the communicable range 802, and the rotating shaft 805. This makes it possible to arrange the first antenna at the maximum distance from the rotating shaft 805 in a range of the enough communication sensitivity of the second antenna. Therefore, the component (polarized wave matching component) parallel to the orientation of the polarized wave from the second antenna can be made maximum in the electric field generated at the position of the second antenna by the first antenna. As a result, the received power of the second antenna can be improved.

In the embodiment, the separation distance between the first antenna and the rotating shaft 805 is X2, but, without limited thereto, it may be sufficient so long as the separation distance between the first antenna and the rotating shaft 805 is equal to or less than the distance X2. This allows the separation distance between the first antenna and the rotating shaft 805 to fall within the range of the enough communication sensitivity of the second antenna and allows a degree of freedom of the first antenna arrangement to be improved.

<Conditions for Arrangement of First Antenna and Second Antenna>

In each embodiment, the arrangement is made such that the polarized wave from the second antenna is not completely contained in a plane perpendicular to the polarized wave from the first antenna. Here, with reference to FIG. 17, a description is given of a condition for the arrangement in which the polarized wave from the second antenna is completely contained in the plane perpendicular to the polarized wave from the first antenna in order to describe a condition for the arrangement in which the polarized wave from the second antenna is not completely contained in the plane perpendicular to the polarized wave from the first antenna.

Figure 17:
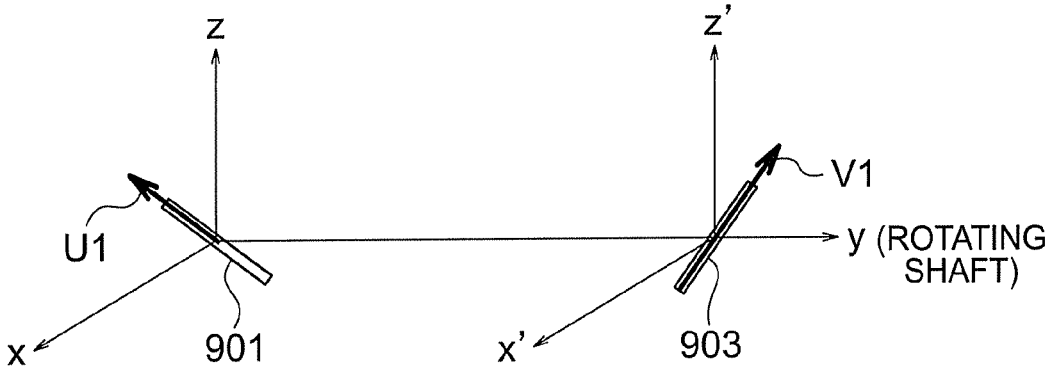
FIG. 17 is a diagram for illustrating the condition for the arrangement in which the polarized wave from the second antenna is contained in the plane perpendicular to the polarized wave from the first antenna.

FIG. 17 is a diagram for illustrating the condition for the arrangement in which the polarized wave from the second antenna is contained in the plane perpendicular to the polarized wave from the first antenna. In FIG. 17, assuming that a first antenna 901 is fixed as an example, and a second antenna 903 is rotated about the rotating shaft (y axis) as an example. A normal vector U1 to a plane perpendicular to the first antenna 901 is ($u_x$, $u_y$, $u_z$). A normal vector V1 to a plane perpendicular to the second antenna 903 is ($v_x$, $v_y$, $v_z$). An antenna center of the first antenna 901 is ($x_1$, $y_1$, $z_1$). As antenna center of the second antenna 903 is ($x_2$, $y_2$, $z_2$). In this case, the plane perpendicular to the first antenna 901 is expressed by the next formula (11).

$$u_x(x-x_1)+u_y(y-_1)+u_z(z-z_1)=0 \tag{11}$$

A line containing the rotation-side antenna is expressed by the next formula (12).

$$\begin{cases} x = x_2 + v_x t \\ y = y_2 + v_y t \\ z = z_2 + v_z t \end{cases} \tag{12}$$

Here, "t" is an arbitrary factor.

The condition for the arrangement in which the second antenna 903 is contained in the plane perpendicular to the first antenna 901 is the case where the formula (11) holds in an arbitrary set (x, y, z) calculated from the formula (12), and therefore, it may be sufficient so long as the next formulas (13) and (14) hold.

$$u_x v_x+u_y v_u+u_z v_z=0 \tag{13}$$

$$u_x(x_1-x_2)+u_y(y_1-y_2)+u_z(z_1-z_2)=0 \tag{14}$$

In other words, the condition for the arrangement in which the second antenna is completely contained in the plane perpendicular to the first antenna is that the normal vectors to the planes perpendicular to both antennas are perpendicular to each other, and that the normal vector to the plane perpendicular to one antenna is perpendicular to a vector from the one antenna to the other antenna. Therefore, the condition for the arrangement in which the second antenna is not completely contained in the plane perpendicular to the first antenna is that at least either one holds, that is, that the normal vectors to the planes perpendicular to both antennas are not perpendicular to each other, or that the normal vector to the plane perpendicular to the one antenna is not perpendicular to the vector from the one antenna to the other antenna.

The configurations in the embodiment described above are collectively shown below. In each embodiment, the wireless communication device includes the first antenna having the linearly-polarized wave, and the second antenna which performs at least one of transmission and reception of the electromagnetic wave to and from the first antenna while rotating and is arranged such that the polarized wave is not completely contained in the plane, the plane including the antenna center of the first antenna and being perpendicular to the polarized wave from the first antenna even if rotating.

This leads to that even if the second antenna is rotated, the polarized wave from the second antenna is not completely contained in the plane which includes the antenna center of the first antenna and is perpendicular to the polarized wave from the first antenna. As a result, since the polarized wave from the first antenna is not perpendicular to the polarized wave from the second antenna, the rotation angle can be eliminated at which the communication between the first antenna and the second antenna is disabled while the second antenna is rotated.

Furthermore, the distance between the first antenna and the second antenna is equal to or more than the critical distance which is determined based on the aperture length of the first antenna, the aperture length of the second antenna, and the wavelength at the communication frequency between the first antenna and the second antenna. This allows the communication between the first antenna and the second antenna to meet the condition for the far field.

Specifically, as an example, in the case where the aperture length of the first antenna and the aperture length of the second antenna are one half of the wavelength at the communication frequency therefor, the distance between the first antenna and the second antenna is equal to or larger than twice the wavelength at the communication frequency therefor.

The one antenna is arranged at a position apart from the line which passes through the other antenna and is parallel to the rotating shaft when the second antenna is rotated.

This makes it possible to, rather than when the one antenna is on the line, increase the polarized wave matching component which is parallel to the polarized wave from the other antenna in the electric field generated at a position of the other antenna by the one antenna.

Here, assuming that in the first antenna and the second antenna, the field emission pattern when the electric field emitted by the one antenna reaches the other antenna is asymmetric about a long axis of the one antenna, the distance between the one antenna and the line which passes through the other antenna and is parallel to the rotating shaft when the second antenna is rotated meets the conditions below. The distance is equal to or less than a distance determined based on the angle formed by a line, which passes through the antenna center of the other antenna and which extends to a direction of communicable limit angle of the other antenna, and a line, which passed through the other antenna and which is parallel to the rotating shaft, and also based on the distance between the first antenna and the second antenna along the rotating shaft.

This allows the second antenna, even if being rotated, to be contained in the communicable range of the one antenna. As a result, even if the second antenna is rotated, the communication between the first antenna and the second antenna can be continued. Therefore, even in the case where the field emission pattern from the antenna center is asymmetric, that is, the antenna has asymmetric antenna directivity, a stable communication can be achieved independent of the rotation angle of the second antenna.

The one antenna is arranged at a position apart from the rotating shaft and the other antenna is arranged on the rotating shaft (in FIG. 6, as an example thereof). This, as shown in FIG. 7, leads to that even if the second antenna is rotated, the polarized wave matching component parallel to the polarized wave from the first antenna can be constant in the electric field generated at the position of the first antenna by the second antenna. This allows the communication sensitivities of the first antenna and the second antenna (e.g., received power or transmission power) to be closer to a constant value independent of the rotation angle of the second antenna.

In this case, in the first to fourth embodiments, the above one antenna is the second antenna and the above other antenna is the first antenna, as an example. In other words, the first antenna is arranged on the rotating shaft and the second antenna is arranged at a position apart from the rotating shaft (see FIG. 6).

In the sixth embodiment, the one antenna is the first antenna and the other antenna is the second antenna, as an example. In other words, the first antenna is arranged at a position apart from the rotating shaft and the second antenna is arranged on the rotating shaft (see FIG. 15).

In the above-described embodiments, the power is supplied by use of the slip ring, but not limited thereto. A power feeding coil and a power receiving coil may be included to wirelessly transmit the power by way of electromagnetic field coupling.

Figure 18:
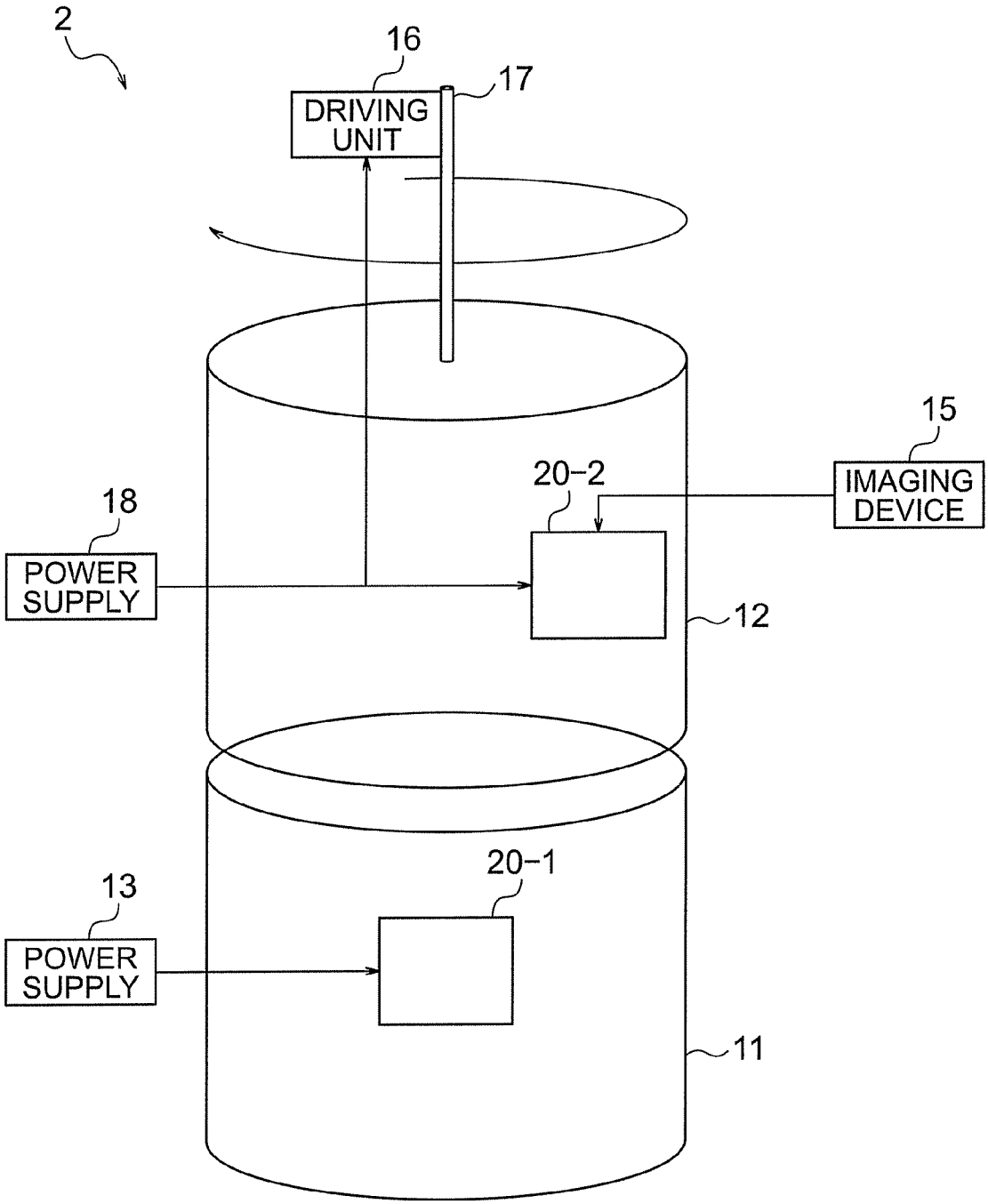
FIG. 18 is a schematic block diagram illustrating a configuration of a wireless communication device 2 according to a modification example of the first to sixth embodiments.

As shown in FIG. 18, the second communication unit 20-2 and the driving part 16 may be supplied with the power from another power supply 18.

FIG. 18 is a schematic block diagram illustrating a configuration of a wireless communication device 2 according to a modification example of the first to sixth embodiments. Elements common to FIG. 1 are denoted by the same numerals and the specific description thereof is omitted. The configuration of the wireless communication device 2 in the modification example is different from the configuration of the wireless communication device 1 in the first embodiment in that the slip ring 14 is removed and the second communication unit 20-2 and the driving part 16 are connected to the power supply 18. The second communication unit 20-2 and the driving part 16 operate using the power supplied from the power supply 18.

As described above, in the embodiments, the wireless communication device includes the first antenna, and the second antenna which performs at least one of transmission and reception of the electromagnetic wave to and from the first antenna while rotating at a predetermined position or revolving along a predetermined orbit. The first antenna is arranged such that an element of the first antenna is not to be parallel to a plane perpendicular to a polarization plane of the electromagnetic wave which is transmitted from one antenna toward the other antenna while the second antenna rotates or revolves.

In the embodiments, the second antenna may be arranged outside or inside a disk that does not have the rotating shaft.

In the embodiments, a cross section of a plane perpendicular to the y axis (rotating shaft) of the housing (or disk) where the second antenna is arranged may be not only a true circle but also an ellipse.

In the embodiments, the second antenna may be provided with a rail in a form of a circle or ellipse to be rotated along the rail.

In the embodiments, kinds of the first antenna and second antenna are not limited to the dipole antenna, but may be a monopole antenna and various loop antennas, for example.

In the embodiments, the communication is performed at a frequency of a millimeter waveband (e.g., 60 GHz), but not limited thereto, and may be performed at a frequency with a millimeter waveband or more. This allows the wavelength to be equal to or less than a wavelength of millimeter waveband (e.g., 5 mm), shortening a distance between the first antenna and the second antenna. As a result, the wireless communication device can be reduced in size.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A wireless communication device comprising:

a first antenna; and a second antenna which performs at least one of transmission and reception of an electromagnetic wave to and from the first antenna while rotating at a position or revolving along an orbit, wherein, the first antenna is arranged such that a polarization plane of an electromagnetic wave which would be transmitted the first antenna toward the second antenna is not to be parallel to a plane perpendicular to a polarization plane of an electromagnetic wave which would be transmitted from the second antenna toward the first antenna while the second antenna rotates or revolves.

2. The wireless communication device according to claim 1, wherein, the second antenna revolves along the orbit, and a field emission pattern of the first antenna is asymmetric about a rotating shaft in revolving of the second antenna, and the first antenna is set in one or both of arrangements that the first antenna is inclined toward the rotating shaft in rotating of the second antenna and that the first antenna is arranged at a position apart from the rotating shaft.

3. The wireless communication device according to claim 2, wherein, the first antenna is inclined toward the rotating shaft such that the second antenna falls within a communicable range for the first antenna while the second antenna revolves.

4. The wireless communication device according to claim 3, wherein, the first antenna is located on the rotating shaft when the second antenna revolves, and a distance between the second antenna and the rotating shaft is equal to or less than a distance determined based on an angle formed by the rotating shaft and a line which passes through an antenna center of the first antenna and which extends to a direction of communicable limit angle of the first antenna, and also based on a distance between the first antenna and the second antenna along the rotating shaft.

5. The wireless communication device according to claim 2, wherein, the first antenna is arranged at a position apart in a vertical direction from the rotating shaft in revolving of the second antenna.

6. The wireless communication device according to claim 5, wherein, a distance between the first antenna and the rotating shaft is determined based on a minimum received power and a maximum received power of the first antenna, a distance between the first antenna and the second antenna along the rotating shaft, and a distance between the second antenna and the rotating shaft, the minimum received power and the maximum received power of the first antenna being in a case where the first antenna is arranged at a point at which a perpendicular line from the first antenna to the rotating shaft intersects with the rotating shaft.

7. The wireless communication device according to claim 5, wherein, the first antenna is arranged at a position apart from the rotating shaft when the second antenna revolves, and a distance between the first antenna and the second antenna along a direction perpendicular to the rotating shaft is equal to or less than a distance determined based on an angle formed by a line, which passes through an antenna center of the first antenna and which extends to a direction of communicable limit angle of the first antenna, and a line, which passes through the antenna center of the first antenna and which is parallel to the rotating shaft, and also based on a distance between the first antenna and the second antenna along the rotating shaft.

8. The wireless communication device according to claim 1, wherein, a maximum communication sensitivity direction of the second antenna is directed to a direction of the first antenna while the second antenna revolves.

9. The wireless communication device according to claim 1, wherein, an angle formed by the second antenna and the rotating shaft is constant while the second antenna revolves.

10. The wireless communication device according to claim 1, wherein, the second antenna is rotated around a rotating shaft at a predetermined position, a field emission pattern of the first antenna is asymmetric about the rotating shaft, and the first antenna is arranged at a position apart from the rotating shaft.

11. The wireless communication device according to claim 10, wherein, a distance between the first antenna and the rotating shaft is equal to or less than a distance determined based on an angle formed by the rotating shaft and a line which passes through an antenna center of the second antenna and which extends to the direction of communicable limit angle of the second antenna, and also based on a distance between the first antenna and the second antenna along the rotating shaft.

12. The wireless communication device according to claim 1, wherein, a distance between the first antenna and the second antenna is equal to or more than a critical distance which is determined based on an aperture length of the first antenna, an aperture length of the second antenna, and a wavelength at a communication frequency between the first antenna and the second antenna.

13. The wireless communication device according to claim 12, wherein, the aperture length of the first antenna and the aperture length of the second antenna are one half of the wavelength at the communication frequency, and the distance between the first antenna and the second antenna is equal to or larger than twice the wavelength at the communication frequency.

14. The wireless communication device according to claim 1, wherein, a communication frequency of the first antenna and the second antenna is a frequency with a millimeter waveband or more.

15. The wireless communication device according to claim 1, wherein, the electromagnetic waves emitted by the first antenna and the second antenna are linearly-polarized waves.

16. A wireless communication method performed by a wireless communication device, the device including a first antenna and a second antenna in which the first antenna is arranged such that a polarization plane of an electromagnetic wave which would be transmitted from the first antenna toward the second antenna is not parallel to a plane perpendicular to a polarization plane of an electromagnetic wave which would be transmitted from the second antenna toward the first antenna while the second antenna rotates or revolves, the method comprising:

a step of performing, by the second antenna, at least one of transmission and reception of the electromagnetic wave to and from the first antenna while rotating at a position or revolving along a orbit.

* * * * *